United States Patent [19]

Blair et al.

[11] 4,223,506

[45] Sep. 23, 1980

[54] FRAMEWORKS AND LIKE STRUCTURES

[76] Inventors: John T. Blair, Single Quarters, South Witbank Colliery, Witabank, Transvaal Province; Maurice J. Gleeson, Witkoppen Close, Witkoppen Rd., Rivonia, Transvaal Province, both of South Africa

[21] Appl. No.: 941,357

[22] Filed: Sep. 11, 1978

Related U.S. Application Data

[63] Continuation-in-part of Ser. No. 798,721, May 19, 1977, abandoned.

[30] Foreign Application Priority Data

May 19, 1976 [GB] United Kingdom ..... 20734/76

[51] Int. Cl.[2] ..... E04B 1/32

[52] U.S. Cl. ..... 52/644; 52/86; 52/167; 52/223 R

[58] Field of Search ..... 52/223 R, 71, 86, 222, 52/741, 167, 644, 640, 639

[56] References Cited

U.S. PATENT DOCUMENTS

| | | | |
|---|---|---|---|
| 1,360,931 | 11/1920 | Graves | 52/644 |
| 1,480,882 | 1/1924 | Davidson | 52/644 |
| 2,567,958 | 9/1951 | Mummert | 52/167 X |
| 2,614,512 | 10/1952 | Gross | 52/644 X |
| 2,653,553 | 9/1953 | Jacobs | 52/641 |
| 2,704,522 | 3/1955 | Frieder et al. | 52/644 X |
| 3,362,117 | 1/1968 | Van Raden | 52/640 X |
| 3,418,768 | 12/1968 | Cardan | 52/167 |
| 3,849,953 | 11/1974 | Cohen | 52/86 |
| 4,021,875 | 5/1977 | Abell et al. | 52/640 X |

FOREIGN PATENT DOCUMENTS

| | | | |
|---|---|---|---|
| 873302 | 3/1942 | France | 52/644 |
| 1331364 | 9/1973 | United Kingdom . | |

*Primary Examiner*—J. Karl Bell

*Attorney, Agent, or Firm*—Sughrue, Rothwell, Mion, Zinn and Macpeak

[57] ABSTRACT

A framework in particular an arch comprising at least one frame member and wherein the framework extends in at least two dimensions, a linkage system associated with the framework and attached thereto at at least three non-collinear positions on the framework, said linkage system embodying two tension members, one of which extends from each of the two outer positions of said three non-collinear positions to the central position thereof where the tension members are each attached to one of two spaced points on a swivel member which is at least swivelable in the plane of the framework and is attached to the framework at the said central position by a connection operable in use, to allow at least limited rotation about a point offset from the line of the tension members and thereby ensure that a change in tension in one of said tension members results in a rotation of the swivel member which causes a change in tension in the other tension member.

10 Claims, 6 Drawing Figures

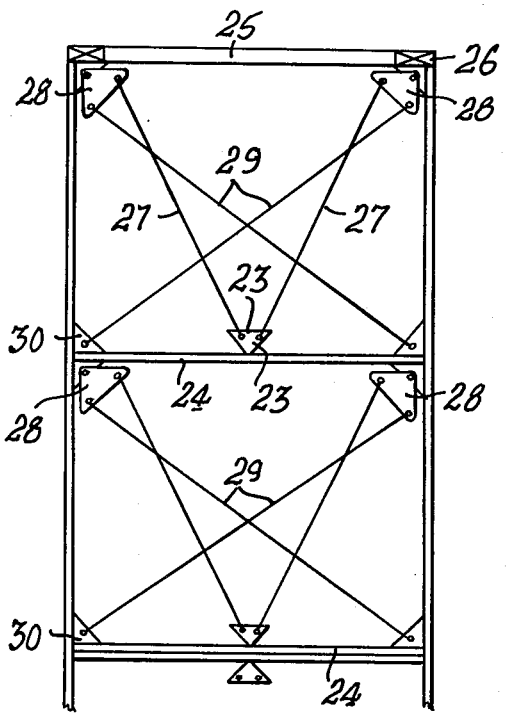
Fig 5.
Fig 6.
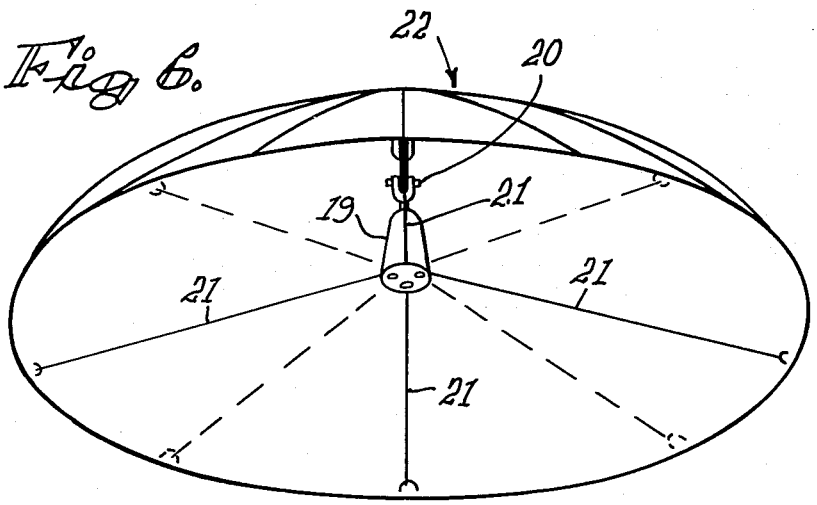

FRAMEWORKS AND LIKE STRUCTURES

This application is a continuation-in-part application of our earlier application Ser. No. 798,721 filed on May 19, 1977 under the identical title now abandoned.

THIS INVENTION relates to frameworks, such as for example, steel, aluminium and other metal frameworks, and like structures, and in particular but not exclusively, the invention relates to frameworks in the form of arches which may have any shape but are usually of a parabolic or circular configuration.

In the design of frameworks, it is often necessary to include compression members as chords and struts to take up compressive forces induced by loads arising as the result of a variety of causes, such as, for example, the dead load of the framework itself, the dead load of cladding or other fixed members supported by the framework, live loads of erection machines and personnel during erection; any live loads for which the framework is designed, and positive and negative loads due to rain, hail, snow, wind temperature changes and earth movements. Because of the compressive stresses induced in the chords and struts, these members have to be made of relatively heavy sections in order to resist buckling.

In the case of arches it is known to avoid the use of compressive chords and struts and simply to include a pair of divergent tension members extending from the crown of the arch to the feet of the arch. Such tension members do not operate in unison to counteract unsymmetrical loads applied to the arch since when the tension in one tension member increases the tension in the other decreases and in fact the latter can go into compression when the unsymmetrical load is sufficiently large. Thus only one of the two tension members is truly operative under unsymmetrical loading conditions. It must be mentioned that an arch, by its very nature, is extremely strong under symmetrical loading conditions and this invention is primarily concerned with frameworks, in particular arches, which are subjected to unsymmetrical loads.

It is an object of this invention to provide a framework which may be lighter in weight than a previously proposed comparable framework for the same purpose.

In accordance with this invention there is provided a framework comprising at least one frame member and wherein the framework extends in at least two dimensions, a linkage system associated with the framework and attached thereto at at least three non-collinear positions on the framework, said linkage system embodying two tension members, one of which extends from each of the two outer positions of said three non-collinear positions to the central position thereof where the tension members are each attached to one of two spaced points on a swivel member which is at least swivelable in the plane of the framework and is attached to the framework at the said central position by a connection operable in use, to allow at least limited rotation about a point offset from the line of the tension members and thereby ensure that a change in tension in one of said tension members results in a rotation of the swivel member which causes a change in tension in the other tension member.

Preferably the linkage system embodies a pair of divergent tension members each of which has one end attached to a pivotally movable plate or bar which constitutes said swivel member whereof the pivot is located between the points of attachment of the tension member thereto.

The pivot is preferably fixed relative to a point on the framework and the axes of the pivot may be substantially coincident with the axis of the frame member to which it is connected or it may be offset therefrom. The other ends of the tension members may be attached to points fixed relative to the framework or may be attached to similar swivelable members such as plates or bars. In the latter instance further tension members are provided which are attached to the plates or bars on the other side of their associated pivots. In any event, ultimately a free end of a tension member is secured relative to the framework at a predetermined position.

The linkage system can be incorporated in the design of an existing framework or framework design.

Probably the most important and broad application of the invention at present envisaged is to arches to increase the stiffness thereof and decrease the stresses therein when unsymmetrical loads are applied thereto. Arches of many different forms such as circular and parabolic arches are widely used in applications where wind forces, moving load or other unsymmetrical loads are applied thereto. In all such applications to arches the swivelable member is usually attached to the crown or centre of the arch and the tension members diverge to be connected at their opposite ends to the feet or free ends of the arch. The invention is applicable to arches having fixed feet, to two pinned arches, and three pinned arches and is of particular advantage when applied to slender arches. The incorporation of the linkage system of this invention improves the stiffness of such arches substantially when unsymmetrical loads are applied thereto.

In other embodiments of the present invention, the linkage system may be used for restraining for the horizontal sway of the deck of a suspension bridge due to wind force. In this case the members of the linkage system operate in the horizontal plane instead of in the vertical plane. Further applications can be designed which will restrict or damp down lateral movement due to wind or other forces in space frames, at the tops of high buildings, towers or pylons, the tops of chimney stacks, cooling towers, gantries and cranes. Furthermore, the linkage system may be incorporated in the design of buildings to resist complete destruction from earthquake disturbances, by virtue of the linkage being applied to relieve stress in the members due to forces induced by such disturbances. In the case of very heavy stresses being induced further stress relief can be obtained by incorporating in the compensating tension design mechanical dampers which may be hydraulic, spring or other type.

In all cases the attachment points on the swivel member and the position about which same can rotate are chosen to ensure that under all predicted loading conditions neither of the tension members can go into compression.

In order to enable the invention to be more readily understood, reference will now be made to the accompanying drawings, which illustrate diagrammatically and by way of example only, some embodiments of the invention.

Figure 4:
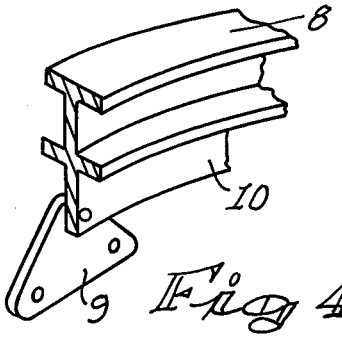
Figure 3:
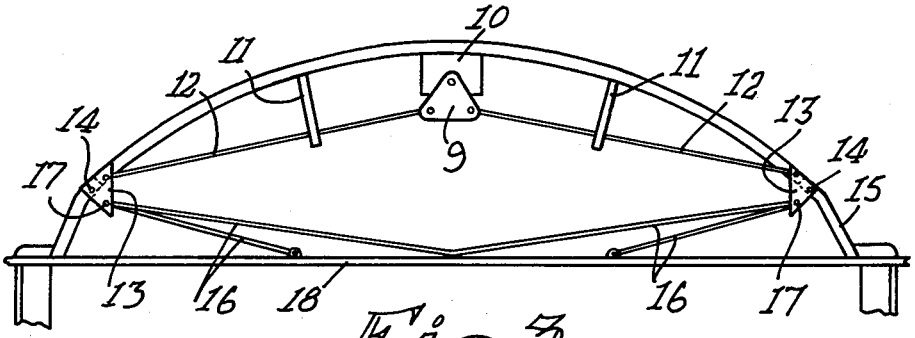

FIG. 3 shows a modification of the arch and also an adaption to support a ceiling, FIG. 4 shows the swivel plate connection used in the arch of FIG. 3, FIG. 5 is a schematic plan view of a framework forming part of the deck of a suspension bridge with different forms of linkage according to the invention applied thereto, and, FIG. 6 illustrates schematically in underneath isometric view the application of the invention to a dome.

Figure 1:
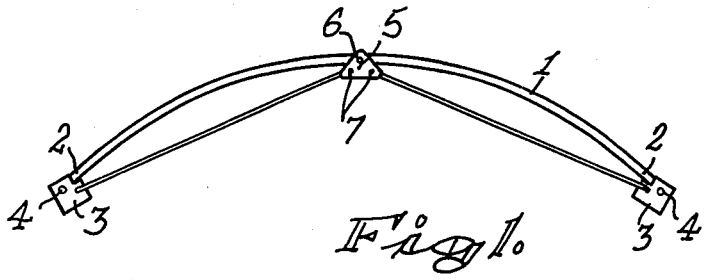
FIG. 1 is a schematic elevation of an arch incorporating a linkage system.
Figure 2:
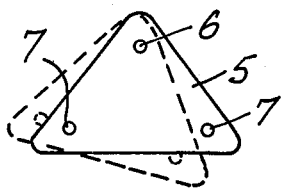
FIG. 2 is an enlarged elevation of a swivel plate used in the arch of FIG. 1.

Referring now to FIG. 1 there is shown an arch 1 formed from a single piece arch rib. It will be understood that whilst a single piece arch rib is considered here the same linkage system could be applied to an arch made in two halves interconnected by a crown pin. The feet 2 of the arch are bolted or welded to springer plates 3 which are secured by pin joints 4 at the same horizontal level to supports (not shown) for the arch. Suspended from the crown of the arch is a triangular swivel plate 5 hinged by a pin 6 to the arch rib with the axis of the pin intersecting the axis of the arch rib. The plate 5 has two additional hinge points 7 each of which is equidistant from the pin 6 whereby the plate is attached to the arch rib and each of which is connected by a tension member 8 to its respective nearer springer plate 3.

The plate 5 is of isosceles triangular shape with the apex directed upwardly and the hinge points 7 are spaced apart and located on the same horizontal level.

A circular two pinned arch as described above has been tested practically and the tests carried out will now be described in order to show the benefits of the invention. In the test arch the arch rib was formed of an aluminium member 38.1 mm wide and 12.7 mm thick. The span of the arch was 1524 mm and the rise 381 mm. The tension members are 9.9 mm diameter aluminium rods.

Two different swivel plates were tested; one (hereinafter referred to as plate (A) in which the two additional hinge points to which the tension members were connected were spaced apart by 50 mm and the pivot connecting the swivel plate to the arch was offset from the centre point between those hinge points by 25 mm and the other of which had the two hinge points spaced by 25 mm and the centre point between them was offset by 30 mm from the pivot 6 connecting the swivel plate to the arch.

The arch was, with each swivel plate in turn loaded at the quarter point i.e. 381 mm from the vertical centreline through the crown of the arch with different loads. The tests revealed that there was a significant reduction in the critical displacement subject to unsymmetrical loading the magnitude depending on the nature of the unsymmetrical loading, the form of the arch and the design of the swivel plate.

Measurements taken were used to calculate the maximum stresses induced in the arch as a result of a loading of 75 kg being applied at the stated position. The results were as follows.

Pure arch without ties: 90 $N/mm^2$($\pm$13034 p.s.i.)

Arch with ties and swivel plate A: 41 $N/mm^2$($\pm$5937 p.s.i.)

Arch with ties and swivel plate B: 57 $N/mm^2$($\pm$8254 p.s.i.)

Thus the effect of the ties and swivel plate is not only to stiffen the arch but also to strengthen it.

It will be understood that the tension members (ties) should be pretensioned suitably in order to be effective and in the case of swivel plate A pretensioning to 200 N was effected whilst with swivel plate B pretensioning to 290 N was effected.

In the case of both swivel plates the horizontal reactions at the supports were reduced by about 25%.

The horizontal deflection of the crown of the arch was substantially decreased owing to the increased stiffness. In the case of swivel plate A the horizontal deflection was only 2.8 mm at a loading of 100 Kg; in the case of swivel plate B 6.6 mm whilst in the case of an untied arch was 8.4 mm.

The above clearly indicates a substantial improvement in the physical characteristics of the arch as a result of the linkage system of the invention. It is, however, to be mentioned that the theoretical analysis of the tied arch of this invention is extremely complex because the rotation of the swivel plate causes the structure to behave non-linearly. As a result no existing structural analysis or computer programme can be used for theoretical design work.

It should also be mentioned that the pretensioning will, of course, change the distance between the springer plates and thus the arch should be made somewhat larger than required initially. The springer plates could then be positioned properly relative to each other by effecting pretensioning of the tension members or ties.

A preferred manner of constructing a three pin arch is again to make the horizontal span of the arch slightly greater than required. The springer plates are then located at the required spacing and may, for this purpose, be attached to their final supports if desired. This causes the pin joint to move upwardly and thereby define a somewhat Gothic shaped arch. The tension members are then applied to pull the pin joint downwardly but not sufficiently to completely destroy the Gothic shape. In one test model of this arrangement the required span was 35 feet. The arch (in a non Gothic configuration) was made to a span of 35'4" which, when the springer plates were spaced at the required 35 feet, gave rise to the pin joint rising by 6". Tension was applied to the tension members to move the pin joint down by 4" to provide the final arch.

The ends of the tension members may be hinged to the free ends of arms rigidly secured to the arch inwardly of the springer plates. This would give rise to a correcting bending moment being applied to the arch when it is deformed.

Also the ends of the tension members remote from the plate may be hinged to the springer plates at a position spaced from the pin joints or at a position coincident with the pin joints or, in fact, to the arch supports where they are sufficiently immovable and/or rigid.

FIG. 3 illustrates a variation in the form of arch and in particular illustrates an arch which is suitable for use as a support in a multispan roof having valley gutters stiffened to take the loading of the arches. In this case the arch member 8 may be made of an I-sectioned metal member as shown more clearly in FIG. 4. In such a case it is inconvenient to hinge a swivel plate 9 to the I-beam and in such a case a support plate 10 is welded to the underside of the arch at the crown. The swivel plate is then hinged to the plate 10.

FIG. 3 also illustrates certain modifications which can be made to the arch structure described with reference to FIG. 1 and in particular where the arch has a long span, support guides 11 may be provided to extend downwardly from the arch member 8 itself to support the tension members 12 intermediate their ends. The reason for this is that the tension members will generally be fairly thin and flexible and support in the central region of the length thereof will assist.

The tension members 12 are secured by hinge pins to springer plates 13 which are secured by hinge pins 14 to the ends of the stiffened gutters 15. The plates 13 are similar to the plate 5 above and span ties 16 are hinged to the plates 13 at positions indicated at 17 for supporting a ceiling 18 or other framework.

The swivel plate may be of any desired shape, other than the isosceles triangle described above e.g. circular. The shape of the plate and the arrangement of the hinge points can be chosen in accordance with design considerations, especially if the pin joints are not at the same level. The three hinge points in the plate need not be arranged in an isosceles or any other triangle and could be in a straight line and depending upon design considerations, it may be necessary for the tensions in the tension members to differ from those in the specific cases described.

It should also be mentioned that in any arch structure according to this invention additional tension members can be secured between the basic tension members and the arch at positions intermediate the crown of the arch and the springer points. Such tension members are preferably flexible or they may be rigid in which case their connection to the arch and basic tension members are hinged types of connections. The additional tension members are preferably located with one roughly centrally between the crown and each springer point.

The tension members may be in the form of tubes, rods, angle sections or other rigid members but may also be in the form of a wire rope or other flexible members although the wire rope is not preferred.

All the joints of the linkage system and any other joints in linkages designed for other applications can be hinge, pin, rocker, universal, gimbal or other conventional joints in accordance with the necessities of design. For instance, in a space framed system such as is illustrated in FIG. 6 in the form of a dome, it may be preferable to allow the arm which may take the form of a cone 19 to swing universally from its top joint 20. In this case tension members 21 radiate to the periphery of the dome 22 in any desired pattern.

A system is illustrated in FIG. 5 for applying the invention to a suspension bridge frame (which is horizontal) to dampen sway thereof caused primarily by winds. In this case a plate 23 is hinged to the centre of each transom 24 apart from those 25 at the towers 26. The tension members 27 diverging from these plates are hinged to further plates 28 hingedly mounted at the two opposite ends of the next adjacent transom. Further tension members 29 are hinged to said further plates 28 to cross the other tension members 27 and the opposite ends of these further tension members are hinged to gusset plates 30 at the ends of the transom carrying the associated central plate 23. Again, all tensions members are maintained in compensating tension when a wind force tends to move the bridge deck laterally.

What we claim as new and desire to secure by Letters Patent is:

1. A framework comprising at least one frame member and wherein the framework extends in at least two dimensions, a linkage system associated with the framework and attached thereto at at least three non-collinear positions on the framework, said linkage system embodying two tension members, one of which extends from each of the two outer positions of said three non-collinear positions to the central position thereof where the tension members are each attached to one of two spaced points on a swivel member which is at least swivelable in the plane of the framework and is attached to the framework at the said central position by a connection with the swivel member being in tension between the connection and the points of attachment of the tension members and the connection being operable in use, to allow at least limited rotation about a point offset from the line of the tension members and thereby ensure that a change in tension in one of said tension members results in a rotation of the swivel member which causes a change in tension in the other tension member.

2. A framework as claimed in claim 1 in which two tension members extend divergently from said swivel member.

3. A framework as claimed in claim 1 in which the framework is an arch and the swivel member is located between the ends of the arch.

4. A framework as claimed in claim 3 in which the swivel member is located at the centre of the arch and the two outer positions are located towards the ends of the arch.

5. A framework as claimed in claim 1 in which the swivel member is pivotally connected to the framework.

6. A framework as claimed in claim 5 in which the swivel member is in the form of a plate rotatable about said pivot.

7. A framework as claimed in claim 5 in which the axis of the pivot passes through the frame member to which it is attached.

8. A framework as claimed in claim 5 in which the axis of pivot is offset from the frame member to which it is attached.

9. A framework as claimed in claim 5 in which the pivot is located at one apex of a triangle and the tension members are connected, hingedly one to each of the other to apexes of the triangle.

10. A framework as claimed in claim 9 in which the triangle is an isosceles triangle.

* * * * *